US005491845A

United States Patent [19]

Takimoto

[11] Patent Number: 5,491,845

[45] Date of Patent: Feb. 20, 1996

[54] FASHION BELT AND BUCKLE THEREFOR

[76] Inventor: Kiyotaka Takimoto, 1001-212, Nishiterakata-machi, Hachioji-shi, Tokyo, Japan

[21] Appl. No.: 295,549

[22] Filed: Aug. 25, 1994

[30] Foreign Application Priority Data

Sep. 22, 1993 [JP] Japan ..... 5-257560

[51] Int. Cl.[6] ..... A41F 9/00; A44B 11/00

[52] U.S. Cl. ..... 2/338; 24/68 J; 24/71 J

[58] Field of Search ..... 2/311, 338, 321; 24/68 J, 71 J, 70 J, 585, 625, 633; D2/627, 628, 629, 631, 632, 633, 634, 635, 636, 637, 638, 639

[56] References Cited

U.S. PATENT DOCUMENTS

| | | | |
|---|---|---|---|
| D. 213,972 | 4/1969 | Anderson et al. | D2/627 X |
| D. 253,258 | 10/1979 | Clark | D2/638 |
| 3,171,409 | 3/1965 | Cetrone | 2/311 |
| 4,450,992 | 5/1984 | Casull | D2/629 X |
| 4,521,940 | 6/1985 | Oetiker . | |
| 4,727,630 | 3/1988 | Alan . | |
| 4,797,984 | 1/1989 | Seto et al. . | |
| 5,152,013 | 10/1992 | Johnson | 2/321 |
| 5,184,352 | 2/1993 | Maufette | 24/585 |

*Primary Examiner*—C. D. Crowder
*Assistant Examiner*—Shirra L. Jenkins
*Attorney, Agent, or Firm*—Armstrong, Westerman, Hattori, McLeland & Naughton

[57] ABSTRACT

This invention provides a fashion belt capable of being applied to various kinds of materials and various cross-sectional shapes, and tightened and loosened easily. This fashion belt is formed by a belt body (1), and a locking member 30 capable of fixing one end portion of the belt body thereto, receiving the other end portion of the belt body so that the tightening length of the belt body can be regulated, and locking and unlocking the second-mentioned end portion thereof in an arbitrary position of insertion thereof.

11 Claims, 6 Drawing Sheets

FASHION BELT AND BUCKLE THEREFOR

BACKGROUND OF THE INVENTION

1. Field of the Invention

This invention relates to a fashion belt capable of being attached to or detached from a belt of various cross-sectional shapes.

2. Description of the Prior Art

Among the articles in which men and women are dressed, a belt is not only used as a means for only tightening or fixing clothes, but, in recent years, it is also used widely as a decorative article as well. This kind of belt now in use is usually formed out of a skin of various kinds of animals, such as oxhide, or various kinds of hard resins, such as vinyl chloride to a suitable width. The cross-sectional shape of such a belt may be restricted by these materials, and such a belt in use usually has a flat cross-sectional shape. Most of buckles as means for connecting both end portions of such a belt have a structure suitable for the cross-sectional shape of a belt, i.e., suitable for fixing a flat belt.

Most of the conventional belts described above have a flat cross-sectional shape, so that buckles for connecting both end portions of the belts have a structure suitable for the cross-sectionally flat belts. Therefore, the non-availability of suitable belt-end-connecting means has constituted one of the causes of preventing the spread of various kinds of three-dimensional belts as fashion belts the improvement of the decorativeness of which has been pursued in recent years.

In order to improve, especially, the decorativeness of a belt, it has been demanded in many cases that materials having a very high degree of unevenness of the surfaces thereof, such as the leather of a crocodile and a big lizard and a braid be used. However, in order to form an integral belt for men's trousers and women's skirts and one-piece dresses without spoiling the characteristics of the uneven surfaces of these materials, it is necessary that both end portions of a belt of such a material be formed so as to have a flat cross-sectional shape for fitting these end portions in a both end-connecting means properly since most of the end-connecting means are formed so that they suit flat belts. To meet this purpose, high-degree belt manufacturing techniques are required. Moreover, since the strength of such flattened end portions decreases greatly, it is difficult to use such materials for manufacturing a fashion belt, and this has prevented an extensive spread of a fashion belt.

SUMMARY OF THE INVENTION

Therefore, the present invention aims at providing a fashion belt capable of being formed variously out of various kinds of materials to various cross-sectional shapes, and tightened and loosened easily.

To solve the above-mentioned problems, a first embodiment of the present invention provides a fashion belt having a belt body, and a locking member capable of fixing one end portion thereof, inserting the other end portion of the belt therein so that the tightening length of the belt can be regulated, and locking and unlocking the second-mentioned end portion thereof in an arbitrary position of insertion thereof; a fashion belt produced by fixing an insert member to the second-mentioned end portion of the fashion belt of the first embodiment and providing a locking member supported resiliently on the insert member, to constitute a second embodiment; a fashion belt produced by providing a plurality of tightening length regulating locking members on a buckle of the fashion belt of the second embodiment so that the locking members are spaced from one another in the lengthwise direction of the buckle, to constitute an invention of a third embodiment; a fashion belt produced by providing locking bores in a rear surface of the fashion belt of the first embodiment, to constitute a fourth embodiment of the invention; a fashion belt produced by fitting projections of the insert member for the buckle in the locking bores in the fashion belt of the fourth embodiment and fixing the projections therein, to constitute a fifth embodiment of the invention; a fashion belt produced by providing such locking bores as are provided in the belt of the fourth embodiment therein plurally so that the locking bores are spaced from one another in the lengthwise direction of the belt, and a locking member, which can be engaged with and disengaged from these locking bores, in the buckle, to constitute an invention of a sixth embodiment; a fashion belt produced by providing locking bores in a rear surface of the fashion belt of the third embodiment, and fitting projections of an insert member for a buckle in these locking bores and fixing the projections therein, to constitute an invention of a seventh embodiment, a fashion belt produced by providing a buckle with an operating member for controlling the engagement and disengagement of the locking member of the fashion belt of the sixth embodiment, to constitute an invention of an eigth embodiment; a fashion belt produced by forming a three-dimensional pattern on a front surface of the buckle on the fashion belt of the first embodiment, to constitute an invention of a ninth embodiment; and a fashion belt produced by providing a slip preventing member on a rear surface of the fashion belt of the first embodiment, to constitute a tenth embodiment of the invention.

In the first embodiment of the invention, the fashion belt is tightened by inserting a free end portion of the belt into a buckle to which the other end portion of the belt is fastened, regulating the belt to a suitable tightening length, and putting the locking member in an engaged state so as to fix the belt in an arbitrary tightened state. The fashion belt is removed by unlocking the locking member and withdrawing the other end portion of the belt from the buckle. In the second embodiment of the invention, a free end portion of the belt is inserted into the buckle in the first embodiment by putting the insert member fixed to the same end portion of the belt thereinto, and removed from the buckle by withdrawing the insert member therefrom.

In the third embodiment of the invention, the insert member is put into the buckle in the second embodiment and engaged with an arbitrary portion of a plurality of locking members provided on the buckle, so as to regulate the tightening length of the belt. In the fourth embodiment of the invention, the tightening length of the belt is regulated by fixing the insert member in a locking bore provided in the rear surface of the belt in the first embodiment, or using locking bores similar to the mentioned locking bore and provided plurally in the same surface and a locking member engageable with these locking bores and provided on the buckle, whereby these locking bores are rendered utilizable for various purposes.

In the fifth embodiment of the invention, the belt is fixed by fitting the projections of the insert member in the locking bores in the fourth embodiment. In the sixth embodiment of the invention, the tightening length of the belt is regulated by fitting the locking member provided on the buckle in an arbitrary locking bore among a plurality of locking bores similar to those in the fourth embodiment of the invention and provided so as to be spaced from one another in the lengthwise direction of the belt. In the seventh embodiment of the invention, the insert member in the third embodiment is fixed to a free end portion of the belt by fitting and fixing the projections of the insert member in the locking bores provided in the rear surface of the belt.

In the eighth embodiment of the invention, the engaging and disengaging of the locking member in the sixth embodiment with and from a locking bore are done by actuating the operating member provided on the buckle. In the ninth embodiment of the invention, the decorativeness of the belt is further improved by forming a three-dimensional pattern on the front surface of the buckle in the first embodiment of the invention of claim 1. In the tenth embodiment of the invention, the slip preventing member on the rear surface of the belt contacts the clothes while the belt is in use, so that the belt does not slip off during the use thereof.

DESCRIPTION OF THE PREFERRED EMBODIMENTS

Figure 1:
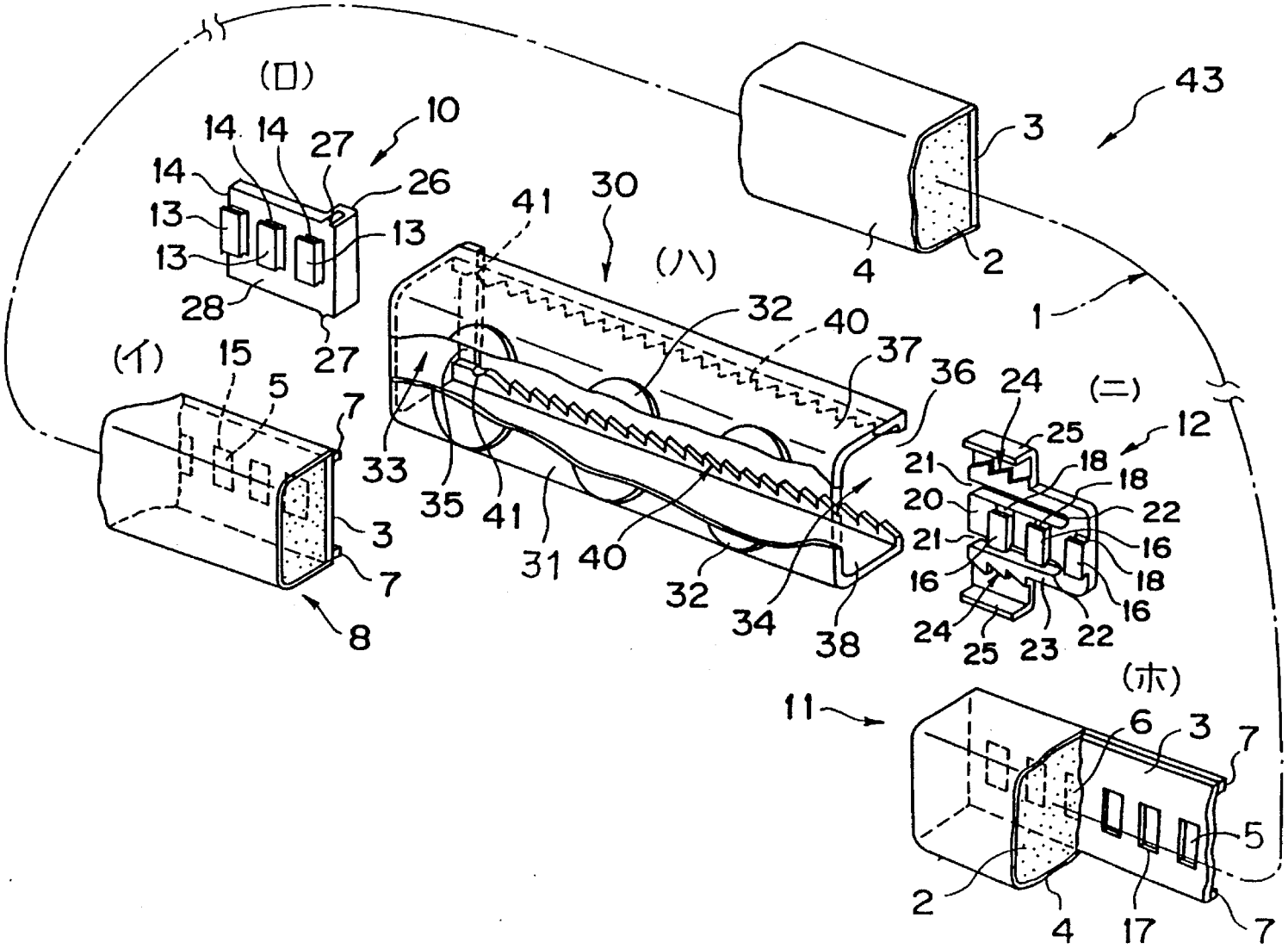
FIG. 1 is a perspective view showing the outline of a first embodiment as a whole of the present invention.
Figure 2:
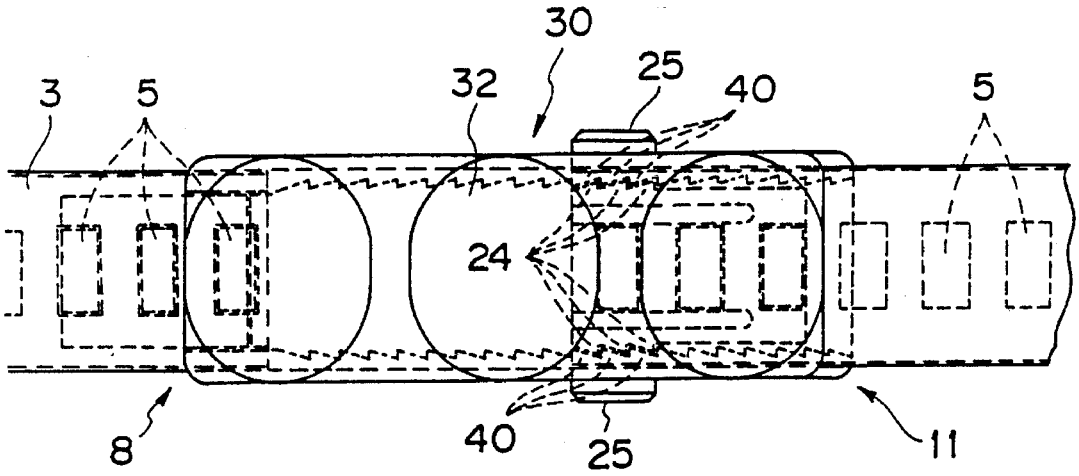
FIG. 2 is a plan view of a principal portion of the same embodiment.
Figure 3:
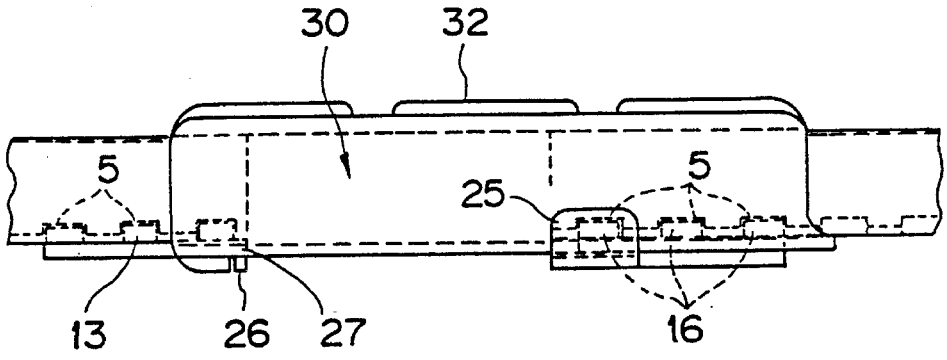
FIG. 3 is a side elevation of what is shown in FIG. 2.
Figure 4:
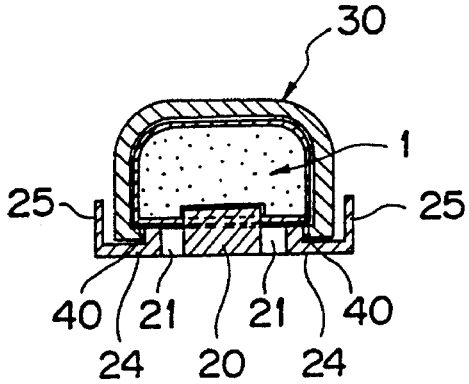
FIG. 4 is a sectional view of what is shown in FIG. 2.

The embodiments of the present invention will now be described with reference to the drawings. FIGS. 1– 4 show a first embodiment of the present invention. A belt 1 has a three-dimensional belt body of a predetermined cross-sectional shape which consists of a shape retaining member 2 of a soft sponge, for example, vinyl chloride sponge and urethane sponge, and a base strip 3 of, for example, polyethylene which easily gets fit to a trunk of a human body while the belt is in use, and which has a sufficiently high tensile strength, is pasted on a rear surface of the shape retaining member 2. A covering sheet 4 consisting of a film of a soft synthetic resin, for example, vinyl chloride and urethane rubber or a cloth is pasted on a front part of the outer circumferential surface of the shape retaining member 2 so as to cover the same therewith. At least the portions of the base strip 3 which are in the vicinity of both ends of the belt are provided with a plurality of locking bores 5 arranged in the lengthwise direction of the belt, and the portions of a rear surface of the shape retaining member 2 which are opposed to these locking bores 5 locking recesses 6. Slip preventing members 7 consisting of a material, such as urethane rubber or urethane sponge which closely contacts and rarely slips on the clothes when the rear surface of the belt in use contacts the clothes, and which gives a user a feeling of tightness, are pasted on both of the lengthwise edge portions of the rear surface of the belt 1.

A fixing member 10 shown in FIG. 1 and an insert member 12 are fastened to first and second end portions 8, 11 respectively of the belt 1 thus formed. Three projections 13 in the embodiment of FIG. 1, the shape of which is substantially identical with that of the locking bores 5 in the belt 1, and the pitch of which is equal to that of the same locking bores 5, are provided on the front surface of the fixing member 10, and locking grooves 14 are formed in both end surfaces of the projections 13. In order to fasten this fixing member 10 to the first end portion 8 of the belt, the projections 13 of the fixing member 10 are applied from the rear side of the base strip 3 of the belt to the locking bores 5 and then pushed thereinto forcibly, so that the front end portions of the projections 13 pass through the locking bores 5 and enter the locking recesses 6 in the shape retaining member 2. During this time, both end portions 15 of the walls defining the locking bores 5 enter the locking grooves 14 in the projections 13 and serve as means for preventing the fixing member 10 from coming off. In order to fasten the insert member 12 to the second end portion 11, steps similar to those in the operation for fastening the fixing member 10 are taken. Namely, projections 16 provided in a mutually spaced manner on the central portion of the front surface of the insert member 12 are applied to the locking bores 5 formed in the portion of the base strip 3 which corresponds to the second end portion 11, and they are pushed thereinto forcibly, so that the front end portions of the projections 16 pass through the locking bores 5 and enter the locking recesses 6 in the shape retaining member 2. During this time, both end portions 17 of the walls defining the locking bores 5 enter locking grooves 18 in both end surfaces of the projections 16 and serve as means for preventing the insert member 12 from coming off.

As shown in FIG. 1, the insert member 12 is provided with a central plate member 20 having the projections 16, and an elastic member 23 which has clearances 21 between itself and both side surfaces of the central plate member 20, and which extends from end portions 22 of the clearances 21 in parallel with the central plate member 20. The elastic member 23 is provided at the upper end portions thereof with outwardly extending sawtooth locking members 24, and pressing flaps 25 projecting from the outer sides of the locking members 24 so that the pressing flaps 25 are spaced from the sawtooth locking members 24. Both a locking force which will be described later of the locking members 24 and those engageable therewith of the buckle, and a pressing force for taking the two opposed pressing flaps 25 in tight grip between the thumb and finger and disengage the locking members 24 are regulated suitably by setting the thickness and length of the elastic member 23.

The fixing member 10 is provided at its end portion with a rearwardly extending fixing projection 26, which has locking projections 27 on both side surfaces thereof. The width of a plate 28 on which the projections 13 of the fixing member 10 are supported is set to such a level that permits the fixing member 10 to be inserted between the slip preventing members 7 on both side portions of the rear surface of the belt when the fixing member 10 is fastened to the first end portion 8 of the belt.

The buckle 30 has a substantially C-shaped cross-sectional shape, and is provided on its front surface 31 with suitable three-dimensional patterns 32 consisting, for example, of three elliptic members shown in the drawing. Both ends of the buckle 30 form first and second openings 33, 34, and the first opening 33 is provided with a stopper plate 35 which prevents the same opening from being expanded, and which is adapted to engage the fixing projection 26 of the fixing member 10, the buckle 30 having a substantially D-shaped cross section at this opening 33.

In rear opening 36 of the buckle 30, sawtooth locking members 40 are formed so as to extend from end portions of upper and lower side walls 37, 38 toward each other, and locking recesses 41 are provided in the portions of the locking members 40 which are close to the stopper plate 35. Accordingly, when the first end portion 8 of the belt 1 is inserted into the first opening 33 of the buckle 30 and passed through the second opening 34 thereof so as to fasten the fixing member 10 as mentioned above with the first end portion 8 then moved in the opposite direction, i.e., in the belt withdrawing direction, the fixing projection 26 of the fixing member 10 engages the stopper plate 35, and the locking projections 27 at both sides of the fixing projection 26 are fitted in the locking recesses 41, so that the fixing member 10 is fastened to the first opening 33 of the buckle.

In order to use a fashion belt 43 thus formed, the belt 1 is passed around a trunk of a user, and an insert member 12 at an end portion of the belt 1 is inserted into the second opening 34 of the buckle 30. Consequently, the locking members 24 of the insert member 12 contact the locking members 40 of the buckle 30, and the locking members 24, 40 are guided mutually by the inclined portions of their sawtooth bodies thereof. The force for inserting the insert member 12 turns into a force for bending the locking members 24 of the insert member inward against the resiliency of the elastic member 23, and the locking members 24 are pushed inward to engage the inner portions of the locking members 40 in order. When the insertion of the insert member 12 is stopped after the belt tightening force has reached a suitable level, the vertical parts of the sawtooth portions of the locking members 24, 40 are meshed with one another and locked up.

In order to loosen this fashion belt 43 in a locked state, the pressing flaps 25 of the insert member 12 which project to the outer side of the two side walls 37, 38 of the buckle 30 are pressed with the thumb and finger from both sides thereof so as to bend the same inward against the resiliency of the elastic member 23, so that the locking members 24, 40 are disengaged from one another. The insert member 12 can then be removed by withdrawing the same as it is from the second opening 34 of the buckle 30.

Figure 5A:
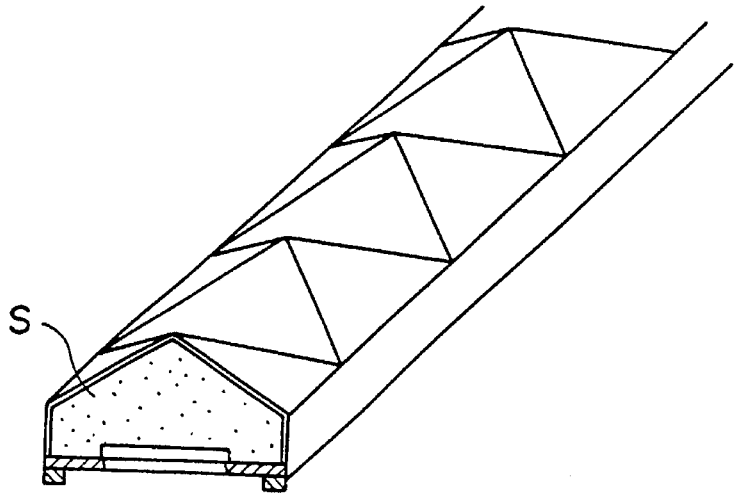
FIG. 5*a–f* is a sectional view of an example of a belt body used in the present invention.
Figure 5B:
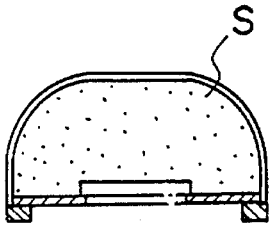
Figure 5C:
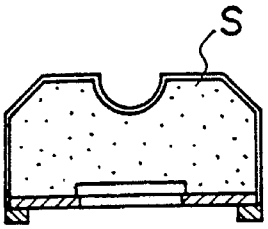
Figure 5D:
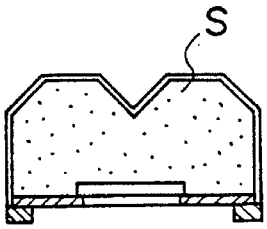
Figure 5E:
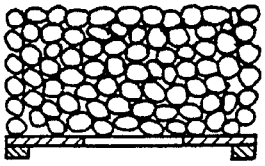
Figure 5F:
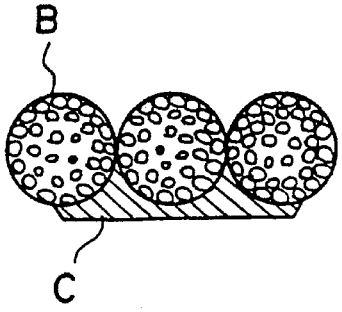
Figure 6A:
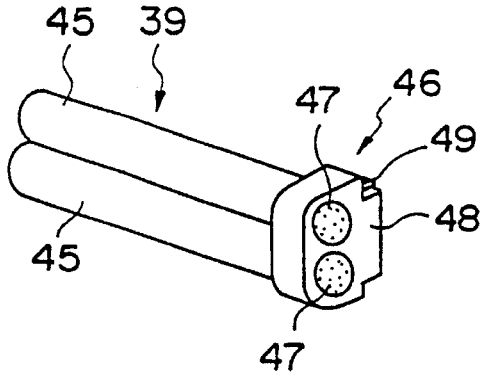
FIG. 6 is a perspective view of a belt end portion of a second embodiment of the present invention.
Figure 6B:
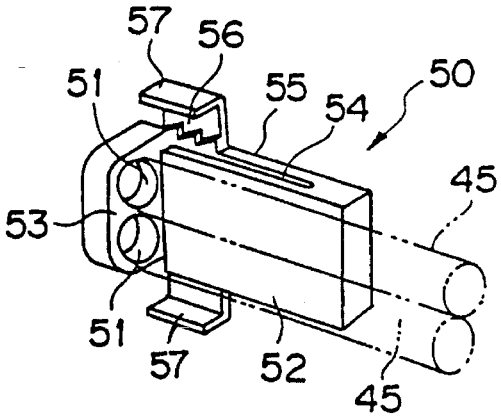
Figure 7:
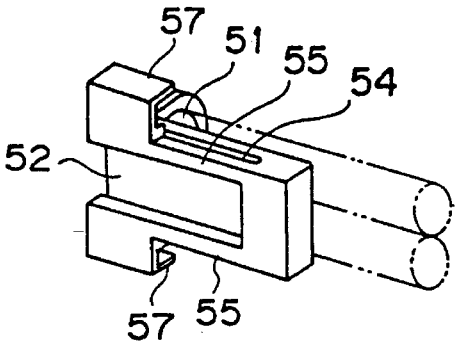
FIG. 7 is a perspective view of an insert member of the same embodiment taken from a rear side thereof.
Figure 8:
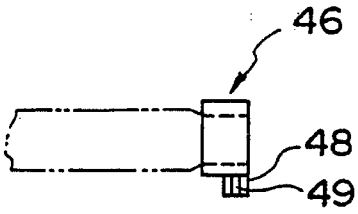
FIG. 8 is a side elevation of a fixing member of the same embodiment.
Figure 9:
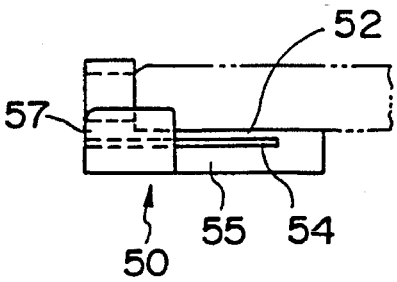
FIG. 9 is a side elevation of an insert member of the same embodiment.
Figure 10:
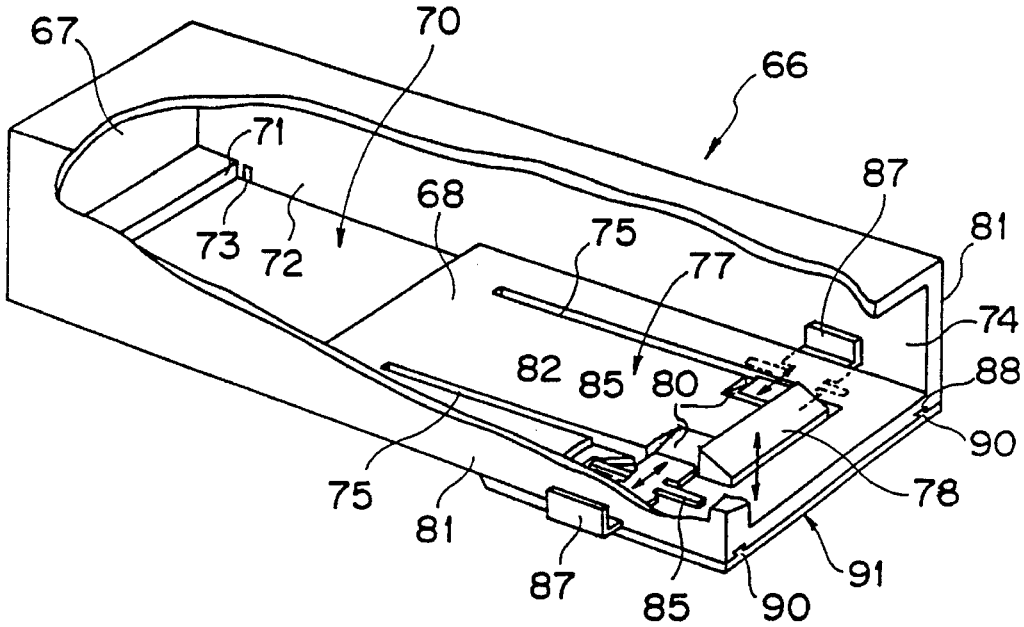
FIG. 10 is a partially cutaway view in perspective of a buckle in the same embodiment.
Figure 11A:
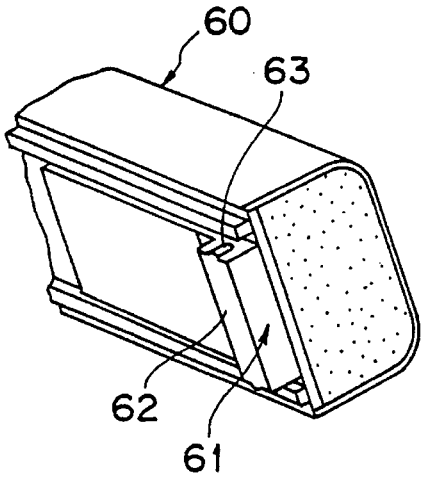
FIG. 11 is a perspective view of a belt end portion of the same embodiment taken from a rear side thereof.
Figure 11B:
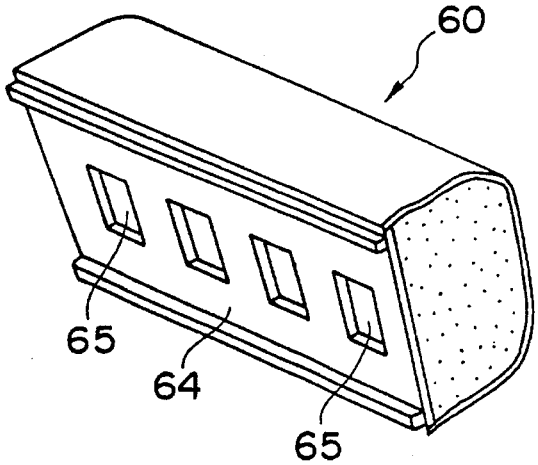

In this embodiment, a belt 1 having a substantially rectangular cross section is shown as an example. For example, belts having various cross-sectional shapes shown in FIG. 5 can also be employed. Namely, a belt the cross-sectional shape of which varies in the lengthwise direction thereof as shown in FIG. 5*a*, a belt having a semicylindrical cross section as shown in FIG. 5*b*, a belt having a cross-sectionally semicylindrical groove in the front surface thereof as shown in FIG. 5*c*, and a belt having a cross-sectionally triangular groove in the front surface thereof as shown in FIG. 5*d* may also be employed. Various materials other than that referred to in the description of the above embodiment may be used for the belt 1. Namely, a bundle of a plurality of fibers, an aggregate of threads or thin strings, and braids shown in FIG. 5*e*, and a material consisting of a plurality of thick strings B arranged side by side and a base strip C bonded to the rear side of the strings B, which is shown in FIG. 5*f*, may also be used.

FIGS. 6–9 show a second embodiment of the present invention. In this embodiment, two thick strings 45 are used as a belt 1. Two bores 47 are formed in a fixing member 46, and first end portions of the thick strings 45 are inserted into these bores 47 and fixed therein by bonding, or thermally pressing the outer circumference as a whole of the fixing member 46, or by some other means, such as caulking. The fixing member 46 is provided on the rear side thereof with a fixing projection 48 similar to the fixing projection 26 of the fixing member 10 in the first embodiment, and locking projections 49 on both sides of the fixing projection 48.

An insert member 50 to be fastened to a free end portion of a belt 39 has bores 51, into which end portions of the two thick strings 45 are inserted, just as the fixing member 46, and the end portions of the thick strings 45 are inserted and fixed in these bores. The insert member 50 is provided at a free end portion of a front plate 52 with a belt fixing projection 53 to which the end portions of the thick strings 45 are fastened. The front plate 52 is provided at the other end portion thereof with two elastic members 55 extending in parallel with the rear surface of the front plate 52 via a slit 54. The elastic members 55 are provided at the free end portions thereof with sawtooth locking members 56 and pressing flaps 57 just as the elastic member 12 provided on the insert member in the previously-described embodiment. Since a buckle in the second embodiment is identical with that used in the first embodiment, a description thereof is omitted.

In order to use a fashion belt 5 having these fixing member 46 and insert member 50 formed at both end portions of the belt 39, the fixing member 46 is fastened to a first opening of the buckle, and the belt is passed around a trunk of a user, the insert member 50 being then inserted into a second opening of the buckle in the same manner as in the previously-described embodiment. Since the operations to be thereafter carried out for pressing the locking members 56 of the insert member 50 and pressing flaps 57 are identical with those in the first embodiment, the descriptions thereof are omitted.

The shape of the buckle used in the second embodiment is substantially identical with that of the fixing member and insert member. Besides the belt using two thick strings mentioned above, a belt using a suitable number of thick strings arranged suitably or bundled suitably can also be employed. In addition, various types of belts shown in FIG. 5 can also be used. Braids used extensively for Japanese clothes can be used as the thick strings, and, when braids are used, a novel fashion belt can be obtained. When square-shaped braids are used for a belt, a fixing member on an end portion of the belt and a fixing portion of an insert member can be molded in accordance with the cross-sectional shape of the braids, and the cross-sectional shape of a buckle is also set in agreement with that of the braids. A front plate may be provided so as to extend over the whole width of the thick strings, or a reinforcing member on the side of the front plate, as a belt-reinforcing base strip in the same manner as in the first embodiment.

A third embodiment of the present invention is shown in FIGS. 10–14. In this embodiment, a fixing member 61 fastened to an end portion of a belt 60 has the same construction as the fixing member in the first embodiment, and is provided with a fixing projection 62 on a rear surface thereof and locking projections 63 at both sides of the fixing projection. A belt having the same construction as the belt of the first embodiment is used as it is as the belt 60 without fixing an insert member to the other end portion theoref. Accordingly, a base strip 64 provided on the rear surface of the belt 60 has a plurality of locking bores 65 spaced from one another in the lengthwise direction of the belt.

A buckle 66 has a substantially rectangular cross section, and an end portion to which the fixing member 61 is fastened of the belt is inserted into a first opening 67 of the buckle in the same manner as in the first embodiment. An end wall 71 of an opening 70 formed in a bottom plate 68 of the buckle and the fixing projection 62 then engage each other with the locking projections 63 on both sides of the fixing projection engaging locking recesses 73 provided in side walls 72 of the opening 70, the fixing member 61 being thus fastened to the first opening 67 of the buckle 66.

The portion of the bottom plate 68 of the buckle which is on the side of a second opening 74 of the buckle is provided with a locking member 77 defined by two side slits 75 and a slit 76 connecting these slits 75 together. This locking member 77 is provided at its free end portion with an inclined surface lowering gradually toward the second opening 74, and a vertical surface-carrying locking portion 78 on the rear side of the inclined surface. This locking member 77 is further provided at both sides of the free end portion thereof with guide surfaces 80 which becomes lower from the central portion of the locking member toward both side portions thereof.

Figure 13:
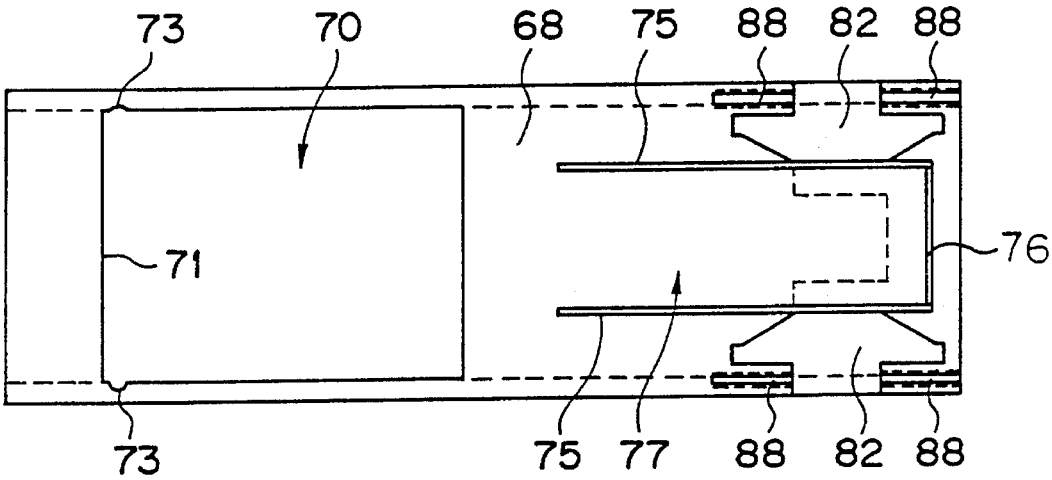
FIG. 13 is a rear view in plan of the same buckle.
Figure 14:
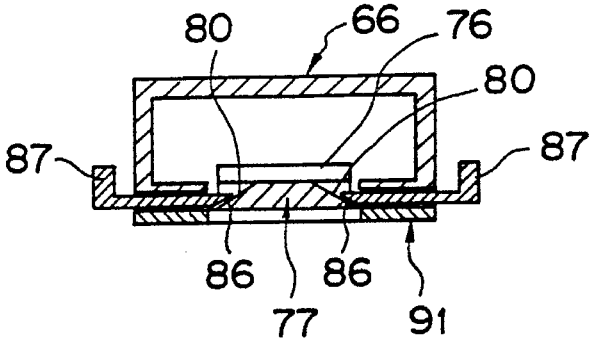
FIG. 14 is a sectional view of the same buckle.

The portions of a rear surface of the bottom plate 68 which correspond to the guide surfaces 80 are provided with operating member-holding recesses 82 each of which consists as shown in FIG. 13 of a substantially wing-shaped recess extending from a substantially central portion of the recess 82 toward the surface of the relative slit 75, and a recess having parallel side surfaces extending from the wing-shaped recess toward the relative side surface 81 of the buckle 66. Owing to this construction, the operating member-holding recesses 82 are in an opened state on the rear side of the buckle 66.

Figure 12:
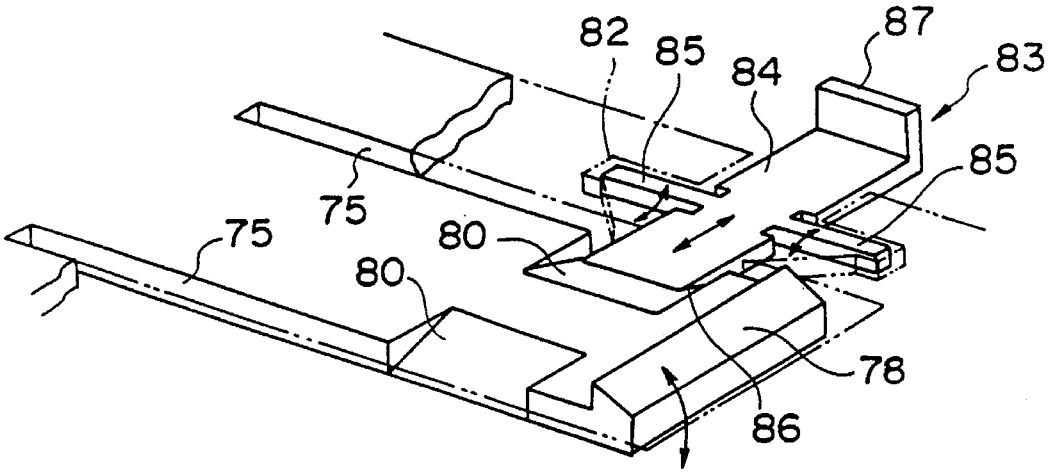
FIG. 12 is a perspective view of a principal portion of the same buckle.

In each of these operating member-holding recesses 82, an operating member 83 shown in FIG. 12 is held. This operating member 83 has resilient rods 85 projecting from the substantially central portion of a central operating plate 84 in the opposite lateral directions, and a locking member pressing portion 86 at the front side of the resilient rods, which pressing portion 86 has a shape and an angle of inclination in accordance with those of the relative guide surface 80 of the locking member 77, the operating plate 84 being provided at an outer end portion thereof with a vertically projecting pressing member 87.

In the portions of the rear surface of the bottom plate 68 of the buckle 66 which are in the vicinity of the operating member-holding recesses 82, dovetail grooves 88 are formed so as to extend in the lengthwise direction of the belt, and a covering plate 91 having projections 90 engageable with the dovetail grooves 88 and projecting from one surface of the plate 91 is put over the rear surfaces of the operating members 83 after the operating members 83 have been held in the operating member-holding recesses 82, the projections 90 being engaged with the dovetail grooves 90 to fix the covering plate 91, whereby the operating members are held operably in the operating member-holding recesses 82.

In order to use this fashion belt, the fixing member 61 is fastened to the first opening 67 of the buckle 66, and a free end portion of the belt 60 is then inserted into the second opening 74 thereof. During this time, the locking portion 78 of the locking member 77 is pressed at the inclined surface of a free end part thereof, so that the locking portion 78 gets over the locking bores 65 sequentially with a free end portion of the belt inserted gradually into the inner portion of the buckle 66. when the insertion of the belt is stopped in a suitable belt tightening position, the locking portion 78 enters a locking bore 65 and is locked up therein owing to the vertical surface of the locking portion 78, so that the disengagement of the locking portion 78 is prevented.

In order to loosen the belt, the pressing members 87 which project from both side surfaces 81 of the buckle of the operating members 83 are pressed from both sides by the thumb and finger, so that the free end portions of the resilient rods 85 of the operating members 83 are supported on both side portions of the wing-shaped recesses of the operating member-holding recesses 82, whereby the movement of the resilient rods is prevented. When the operating members 83 are pushed against the resiliency of the resilient rods 85, the locking member pressing portions 86 enter the guide surfaces 80 of the locking member 77 as the former are guided by the latter, and the locking member 77 is pressed down due to the effects of the inclined surfaces of the locking member 77 and guide surfaces 80. Consequently, the locking portion 78 at the free end of the locking member 77 retracts and disengages from the locking bore 65 in the belt 60, and the free end portion of the belt 60 is put in a free state and becomes ready to be withdrawn from the buckle, i.e., the fashion belt can be removed.

The present invention is not limited to the above-described embodiments. Various other modes of examples and modifications which can be effected by those skilled in the art within the scope of the construction defined in the claims are, of course, included in the invention.

Since the present invention is constructed and operated as described above, three-dimensional belt having various cross-sectional shapes can be used as fashion belts in the invention of the first embodiment, and the leather of crocodile and big lizard which has heretofore been difficult to be used for this kind of belts can be used easily. Moveover, braids can also be used for fashion belts. This enables the decoratively of a belt to be improved. The tightening and loosening of such a belt to be done easily. Owing to the convenience, this fashion belt can be used widely.

The invention of the second embodiment has a capability of using an insert member when a free end portion of a belt is inserted and locked in a buckle, in addition to the same effect as in the invention of the first embodiment. Therefore, the tightening of a belt can be done easily, and various types of belt engaging and disengaging means can be used. The invention of the third embodiment has a capability of using a plurality of locking members provided in a buckle, in addition of the same effect as in the invention of the second embodiment. Accordingly, the belt tightening length regulating members can be operated stably, and the belt engaging, disengaging and tightening operations can be carried out stably. The invention of the fourth embodiment has a capability of fixing a fixing member and an insert member in locking bores and using locking bores as locking members when they are provided plurally in a linear arrangement, in addition to the same effect as in the invention of the first embodiment. The belt according to the fourth embodiment can be applied to various modes of use of the belt of this kind.

The invention of the fifth embodiment uses the locking bores in the invention of the fourth embodiment for fitting the projections of an insert member therein, and has a capability of engaging and disengaging the insert member with and from a belt easily, replacing the belt by another easily and improving the utilizability of the belt, in addition to the effect of the invention of the first embodiment of Claim 1. In the invention of the sixth embodiment, the same locking bores as in the invention of the fourth embodiment are provided plurally so as to be spaced from one another in the lengthwise direction of the belt for the purpose of making it possible to regulate the belt tightening length by engaging a locking member of a buckle with these locking bores, The invention of the sixth embodiment has a capability of regulating the belt tightening length arbitrarily by only inserting a free end portion of a belt into a buckle without providing an insert member additionally, in addition to the effect of the invention of the first embodiment.

The invention of the seventh embodiment displays the effect of the invention of the fifth embodiment in addition to that of the invention of the third embodiment. The invention of the eighth embodiment has a capability of carrying out a belt tightening operation by an operating member having a belt-engageable locking member in a buckle, in addition to the effect of the invention of the sixth embodiment, so that it is not necessary to provide any special operating member on the belt, The belt according to the eighth embodiment is capable of improving the decorativeness of a fashion belt by simplifying the outer appearance thereof.

The invention of the ninth embodiment has a capability of improving the decorativeness of a fashion belt as a whole owing to the three-dimensional patterns on the front surface of a buckle combined with the three-dimensional structure of a belt body, in addition to the effect of the invention of the first embodiment. The invention of the tenth embodiment also has the effect of the invention of the first embodiment. In addition, when the belt of the tenth embodiment is put on the trunk of a user, large friction occurs between itself and the clothes which the belt contacts, so that the belt rarely slides down. Although the three-dimensional belt has increased weight, the slide-down thereof can be prevented.

What is claimed is:

1. A fashion belt comprising:

a belt body including locking bores, a buckle provided with a fixing member capable of fixing one end portion of the belt body thereto, said buckle receiving the other end portion of the belt body so that the tightening length of the belt body can be regulated, and said buckle locking and unlocking the other end portion thereof in an arbitrary position of insertion thereof, and an insert member for said buckle including projections engaged with and fixed in said locking bores.

2. A fashion belt according to claim 1, wherein an insert member is fixed to the other end portion of said belt body, the fixing member resiliently supported on said insert member.

3. A fashion belt according to claim 2, wherein said buckle is provided with a plurality of belt tightening length regulating members arranged in the lengthwise direction thereof.

4. A fashion belt according to claim 1, wherein said locking bores are provided plurally in said belt body so as to be spaced from one another in the lengthwise direction thereof, said buckle being provided with the fixing member engageable with and disengageable from said locking bores.

5. A fashion belt according to claim 4, wherein said buckle is provided with an operating member for controlling the engagement and disengagement of said fixing member.

6. A fashion belt according to claim 1, wherein said buckle is provided with three-dimensional patterns on a front surface thereof.

7. A fashion belt according to claim 1, wherein said belt body is provided with slip preventing members on a rear surface thereof.

8. A fashion belt according to claim 1, wherein said belt body has a rectangular cross section.

9. A fashion belt according to claim 1, wherein said belt body has a semi-cylindrical cross section.

10. A fashion belt according to claim 1, wherein said belt body has a cross-sectionally semi-cylindrical groove in the front surface thereof.

11. A fashion belt according to claim 1, wherein said belt body has a cross-sectionally triangular groove in the front surface thereof.

* * * * *